US005300968A

United States Patent [19]

Hawkins

[11] Patent Number: 5,300,968

[45] Date of Patent: Apr. 5, 1994

[54] APPARATUS FOR STABILIZING THERMAL INK JET PRINTER SPOT SIZE

[75] Inventor: William G. Hawkins, Webster, N.Y.

[73] Assignee: Xerox Corporation, Stamford, Conn.

[21] Appl. No.: 943,822

[22] Filed: Sep. 10, 1992

[51] Int. Cl.[5] ..... B41J 2/05

[52] U.S. Cl. ..... 346/140 R; 307/265; 323/313

[58] Field of Search ..... 346/140 R, 76 PH; 307/265, 268; 323/313, 907

[56] References Cited

U.S. PATENT DOCUMENTS

| | | | |
|---|---|---|---|
| 3,960,778 | 6/1976 | Bouchard et al. | 252/519 |
| 3,971,039 | 7/1976 | Takano et al. | 346/75 |
| 4,087,825 | 5/1978 | Chen et al. | 346/75 |
| 4,275,402 | 6/1981 | Kern | 346/140 R |
| 4,736,089 | 4/1988 | Hair et al. | 346/76 PH |
| 4,774,530 | 9/1988 | Hawkins | 346/140 R |
| 4,791,435 | 12/1988 | Smith et al. | 346/140 R |
| 4,845,514 | 7/1989 | Mitsushima et al. | 346/76 PH |
| 4,899,180 | 2/1990 | Elhatem et al. | 346/140 R |
| 4,980,702 | 12/1990 | Kneezel | 346/140 R |
| 5,036,337 | 7/1991 | Rezanka | 346/1.1 |

*Primary Examiner*—Benjamin R. Fuller
*Assistant Examiner*—Craig A. Hallacher
*Attorney, Agent, or Firm*—Oliff & Berridge

[57] ABSTRACT

A controller controls an ink jet printing apparatus that propels ink jet droplets on demand from a printhead having a plurality of drop ejectors. The printhead includes a plurality of heater elements which are responsive to electrical input signals, each input signal having an amplitude and time duration which produce a temporary vapor bubble and cause a quantity of ink to be ejected for creation of a mark on a copy sheet. The controller has power supply means and delay means that vary the amplitude and duration of the input signals in relation to the printhead temperature.

18 Claims, 4 Drawing Sheets

APPARATUS FOR STABILIZING THERMAL INK JET PRINTER SPOT SIZE

BACKGROUND OF THE INVENTION

1. Field of the Invention

The present invention relates to a controller for a thermal ink jet printer. Specifically, the present invention is a controller for controlling the spot size associated with an ink jet printhead which responds to the temperature of the ink in the printhead.

2. Description of Related Art

In thermal ink jet printing, droplets of ink are selectively emitted from a plurality of drop ejectors of a printhead to create a desired image on a image receiving member. The printhead typically comprises an array of ejectors for conveying ink to the image receiving member. The printhead may move back and forth relative to the image receiving member in order to print the image, or the array may extend across the entire width of the image receiving member. In either case, the image receiving member moves perpendicularly relative to the linear array of the printhead. The ejectors typically comprise capillary channels, or other ink passageways, which are connected to one or more common ink supply manifolds. Ink from the manifold is retained within each channel until, in response to an appropriate signal, the ink in the channel is rapidly heated and vaporized by a heating element disposed within the channel. This rapid vaporization of the ink creates a bubble which causes a quantity of ink to be ejected through the nozzle to the image receiving member. One patent using the general configuration of a typical ink jet printhead is, for example, U.S. Pat. No. 4,774,530 to Hawkins.

When a quantity of ink, in the form of a droplet, is ejected from the ejector to the image receiving member, the resulting spot of ink becomes part of the desired image. Uniformity in the spot size of a large number of droplets is crucial to maintaining image quality in ink jet printing. The human eye is very sensitive to changes in spot size, especially when shaded areas and graphics are being produced. If the volume of droplets ejected from the printhead over the course of producing a single image is permitted to vary widely, this lack of uniformity in droplet volume will have noticeable effects on the ink spot size of the image, and therefore on the quality of the image. Similarly, if volumes of droplets ejected from the printhead differ during subsequent printings of the same image, then printing stability cannot be maintained; this is particularly important in color printing, where the colors produced are highly dependent on the volume ratios of the ejected drops which combine to produce the desired colors.

The most common and important cause of variance in the volume of droplets ejected from the printhead is variations in the temperature in the printhead over the course of use. The temperature of the ink, before vaporization by the heating element, substantially effects the viscosity of the ink. Control of the temperature of the printhead then has long been of primary concern in the art.

In order to maintain a constant spot size from the ink jet printhead, various strategies have been attempted. One example is U.S. Pat. No. 4,899,180 to Elhatem et al., assigned to the assignee of the present application. In this patent, the printhead has integrated into it a number of heater resistors and a temperature sensor which operate to heat the printhead to an optimum operating temperature and maintain that temperature regardless of local temperature variations.

U.S. Pat. No. 4,791,435 to Smith et al. discloses an ink jet system wherein the temperature of the printhead is maintained by using the heating elements of the printhead not only for ejection of ink but for maintaining the temperature as well. The printhead temperature is compared to thermal models of the printhead to provide information for controlling the printhead temperature. At low temperature, low energy pulses are sent to each channel, or nozzle, below the voltage threshold which would cause a drop of ink to be ejected. Alternatively, the printhead is warmed by firing some droplets of ink into an external chamber instead of onto the image receiving member.

PCT Application No. U.S./90/10541 describes a printhead in which the heating cycle for the ink is divided into several partial cycles, only the last of which initiates bubble formation and ejection of a droplet. In this printhead, therefore, the liquid ink is first preheated to its preselected temperature, the ink having known volume and viscosity characteristics, so that the behavior of the ink will be predictable at the time of firing.

PCT Application No. U.S./90/10540 discloses a printhead control system wherein the temperature of the liquid ink is compared with a predetermined threshold value, and if it exceeds this threshold value the pulse energy (proportional to the square of the voltage to the heating element times duration of the pulse) is reduced. According to this patent, the pulse energy may be varied by controlling either the voltage, the pulse duration, or both.

U.S. Pat. No. 4,736,089 to Hair et al. discloses a thermal printhead (as opposed to an ink jet printhead) wherein printhead temperature is sensed by a voltage generating diode on the printhead itself. A detected temperature of the printhead is used to establish a preselected reference level. Bi-stable means are coupled to the thermal printhead to print or not print in a given time. Control means are used to turn the bi-stable means on when the control voltage is less than the reference level related to the temperature, and turns the bi-stable means off when the control voltage exceeds the preselected reference level, thus causing the time duration of a voltage pulse to the thermal printing means to be dependent on temperature.

U.S. Pat. No. 4,980,702 to Kneezel discloses a thermal ink jet printhead wherein outputs from a temperature sensor in the printhead are compared to a high or low level temperature reference. If the sensed printhead temperature is below the reference level, power to the heater in the printhead is turned on. If the temperature sensed is too high, the heater is turned off. The printhead is configured so that the temperature sensor and the heater in the printhead are in close proximity.

SUMMARY OF THE INVENTION

It is therefore an object of the present invention to provide a system for maintaining the spot size of droplets emitted from an ink jet printhead constant in spite of temperature changes.

It is another object of the present invention to provide such a system which controls spot size without requiring direct control of the temperature of the ink in the printhead.

It is another object of the present invention to provide such a system that will maintain droplet size relatively uniform with changes in printhead temperature without the need of close temperature control to the printhead.

It is another object of the present invention to provide such a system on an ink jet chip so that the chip itself is inherently temperature insensitive.

In accordance with the above-stated objects, an ink spot size controller of the present invention comprises a controller for an ink jet printer and a printhead having a plurality of drop ejectors for propelling ink jet droplets on demand. In the printhead, each ejector includes a heating element controlled by electrical input signals, each input signal having an amplitude and a time duration sufficient to cause heating element to produce a temporary vapor bubble and eject a volume of ink to create an ink mark or an image receiving member. The controller senses the temperature of the printhead and varies the amplitude and duration of the input signal to the heating elements to maintain a constant drop volume.

BRIEF DESCRIPTION OF THE DRAWINGS

The preferred embodiments of the invention are described in detail with reference to the following figures wherein.

DETAILED DESCRIPTION OF THE PREFERRED EMBODIMENTS

Figure 1:
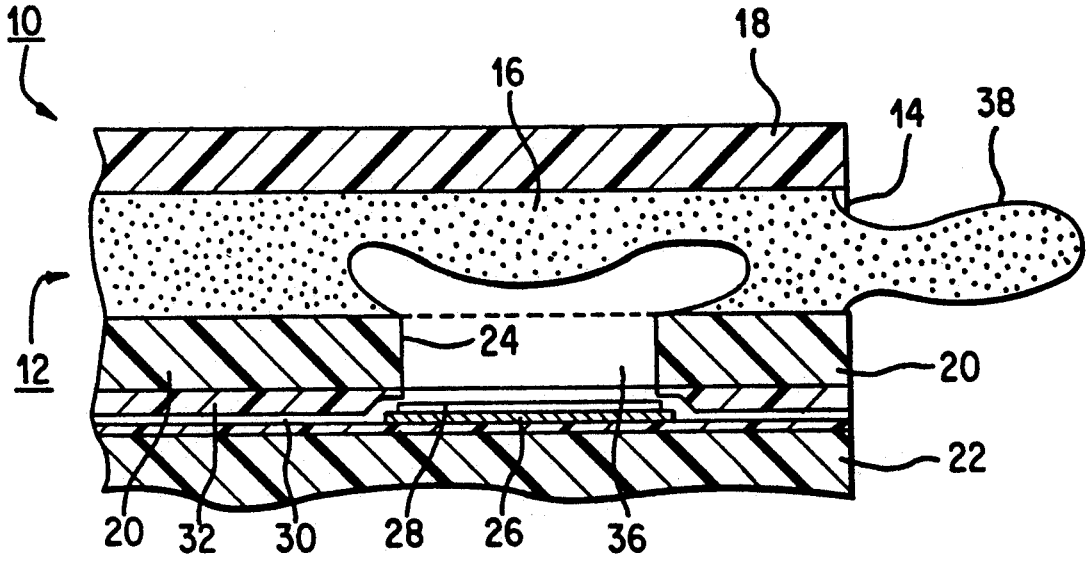
FIG. 1 PRIOR ART
FIG. 1 is a sectional elevational view of a nozzle of an ink jet printhead as a drop is ejected.

FIG. 1 is a sectional elevational view of a drop ejector of an ink jet printhead,one of a large plurality of such ejectors which would be found in the preferred embodiment of the ink jet printhead and ink spot size controller of the present invention. Typically, such ejectors are sized and arranged in linear arrays of 300 ejectors per inch. Other resolutions above 300 spi have also been fabricated. In the preferred embodiment, a silicon member having a plurality of drop ejector channels defined therein, typically 128 ejectors, is known as a die module or chip.

A thermal ink jet apparatus may have a single print bar which extends the full width of an image receiving member on which an image is to be printed, such as 8½ inches or more. The print bar can be constructed from a large number of individual die modules, each with a different sensitivity to temperature. Alternatively, many systems comprise smaller chips which are moved across an image receiving member in the manner of a typewriter, or comprise a plurality of chips which are abutted across the entire substrate width to form the full width printhead. In Full width print bar and color printer designs with multiple chips, each chip may include its own ink supply manifold or multiple chips may share a single common ink supply manifold. Even when many chips share one ink supply, ink is heated substantially after it enters the die module but before ejection.

Each ejector, generally indicated as 10, includes a capillary channel 12 which terminates in an orifice 14. The channel 12 regularly holds a quantity of ink 16 which is maintained within capillary channel 12 until such time as a droplet of ink is to be ejected. Each of the plurality of capillary channels 12 are maintained with a supply of ink from an ink supply manifold (not shown). The channel 12 is typically defined by abutment of several layers. In the ejector shown in FIG. 1, the main portion of channel 12 is defined by a groove anisotropically etched in an upper substrate 18 which is made of crystalline silicon. The upper substrate 18 abuts a thick film layer 20, which in turn abuts a lower substrate 22.

Sandwiched between the thick film layer 20 and the lower substrate 22 are electrical elements which causes the ejection of a droplet of ink from the capillary channel 12. A heating element 26 is positioned within a recess 24 formed in the thick film layer 20. The heating element 26 is typically protected by a protective layer 28 made of, for example, a tantalum layer having a thickness of about 1 micron. The heating element 26 is electrically connected to an addressing electrode 30. Each of the large number of nozzles 10 in a printhead will have its own heating element 26 and individual addressing electrode 30, to be controlled selectively by control circuitry. The addressing electrode 30 is typically protected by a passivation layer 32.

When an electrical signal is applied to addressing electrode 30 to energize the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of an image receiving member. The image receiving member has an image receiving surface on which the droplet 38 is deposited to form an ink spot or mark. The image is formed by the plurality of ink spots or marks. The image receiving member may be, for example, a sheet of paper or a transparency.

Figure 2:
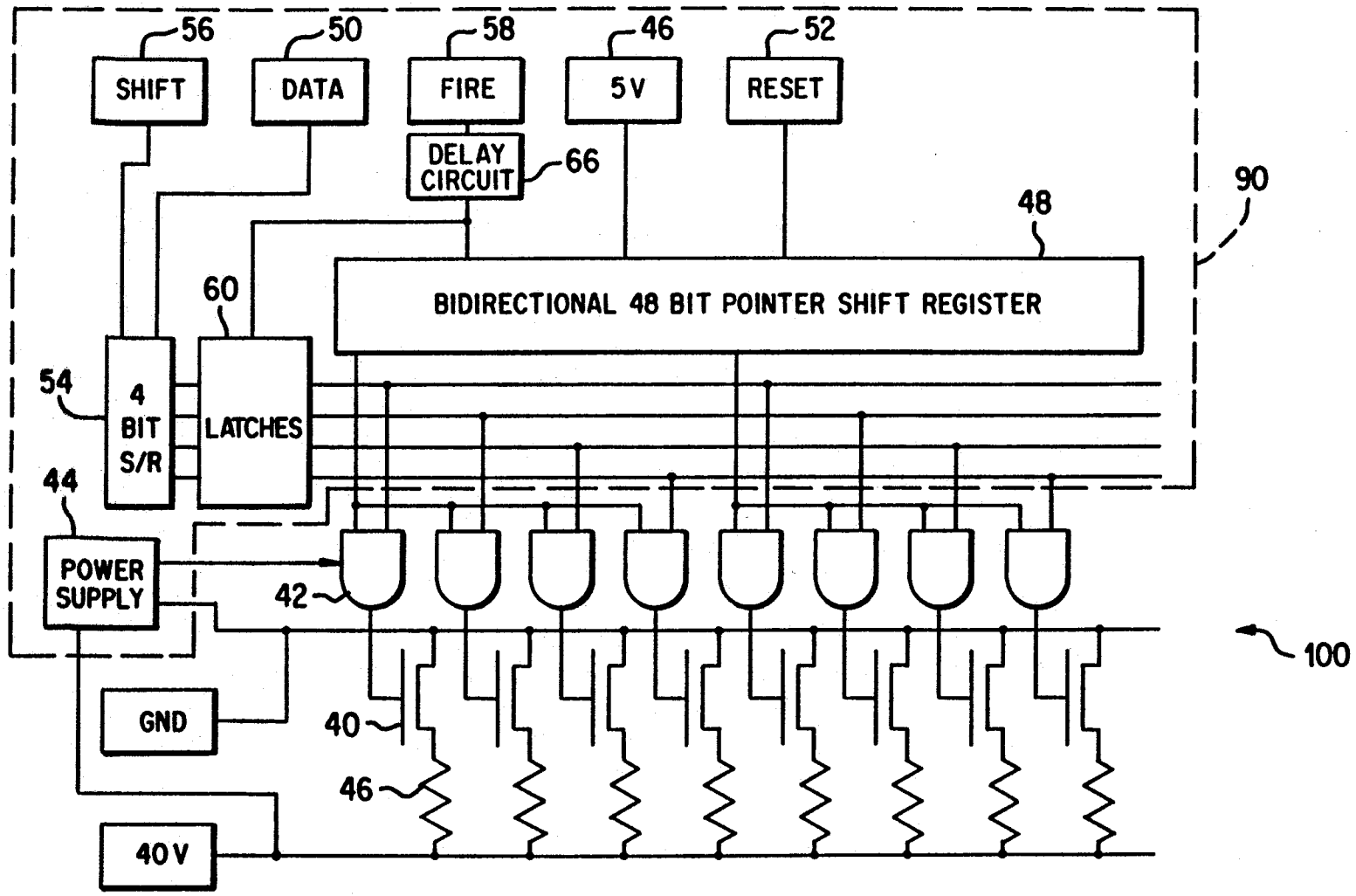
FIG. 2 is a block diagram illustrating one embodiment of an ink jet chip of the present invention.

As mentioned above, the size of the spot created by a droplet 38 on an image receiving member is a function of both the physical qualities of density and viscosity of the ink at the point just before vaporization, which is largely a function of the temperature of the ink, and the kinetic energy with which the droplet is ejected, which is a function of the electrical energy provided to the heating element 26. Thus, in an ink spot size controller 90, as shown in FIG. 2, the power provided to the heating element 26 is dependent on the sensed temperature of the liquid ink. In particular, in the preferred embodiment, the ink spot size controller 90 uses a sensed temperature of the printhead to control the amplitude and duration of the input signal pulse.

In the operation of a drop ejector 10 as shown in FIG. 1, the temperature response of the ejector and the ink therein reflects a complicated process. Drops are ejected from the ejector 10 by activating a heating element 26; in order to obtain a desired spot size, it is necessary to take into account the temperature of the liquid ink at the moment before ejection. However, the very act of ejection itself causes a general increase in temperature around the ejector 10, because of the activation of the heating element 26. Some of this added heat escapes with the ejected ink itself, but a significant portion is retained in the chip. Over even a short period of use, the temperature of the ejector 10 and therefore the temperature of the ink flowing into the ejector 10 will increase substantially.

Most conventional thermal ink jet printers emphasize regulating only the temperature of the ejector 10. That is, conventional thermal ink jet printers operate by preventing the ejector 10 from becoming too hot or too cool, in order to keep the temperature of the ink within a manageable range. In the ink spot size controller 90 of the present invention, the temperature of the ink is not regulated. Rather, the ink spot size controller 90 simply reacts to the sensed temperature of the printhead in the vicinity of the ejector 10, essentially recalculating the necessary energy which must be provided to the ejector 10 for any single ejection or number of ejections. However, this should not be understood to suggest that the thermal ink jet printer of the present invention does not minimize the temperature rise in the printhead. The thermal ink jet printer of the present invention is provided with conventional passive elements, such as a heat sink, in order to minimize the temperature rise in the printhead due to operation of the drop ejectors.

FIG. 2 is a schematic diagram illustrating the basic elements of the preferred embodiment of the present invention. In this embodiment, a thermal ink jet chip 100 comprises 192 thermal ink jet heating elements 26 and power MOSFET drivers 40 to turn the heating elements 26 on and off. Up to four jets are fired together. The shaded AND gates 42 are operated from power supply 44. The power supply 44 provides an output of greater than 5 V and typically about 13 V. The operating voltage of the AND gates 42 enables the power MOSFETS 40 to be turned on harder through application of a higher gate voltage than is available from the 5 V power supply 46. The boxes Shift 56, Data 50, Fire 58, 5 V input 46, and Reset 52 are signal input terminals for connection to printer control electronics.

The circuit of FIG. 2 operates to sequentially address blocks of power MOSFET drive transistors 40. A bidirectional 48-bit shift register 48 is initiated with a single pointer "1" bit. The pointer bit starts on the left and propagates to the right or starts on the right and propagates to the left, depending on the state of data line 50 at the time that the reset line 52 goes high. Bidirectional shifting is necessary for bidirectional printing. The length of the shift register depends on the number of drop ejectors fired together and the total number of drop ejectors. In this example, 192 drop ejectors are fired using a bank of 48 shift registers of 4 bits each.

After the circuit is reset by the reset line 52, four bits of data are loaded from the data line 50 into the 4 bit shift register 54 with the shift pad 56. These four bits of data control whether or not a heating element 26 within the block of four heating elements 26 selected by the shift register 48 will fire. Once 4 data bits are in the 4 bit shift register 54, the fire control pulse **58*a* shown in FIG. 4C generated by fire control generator 58 is used to time the length of the heating cycle. During the fire cycle, four more bits of data are loaded into the 4 bit shift register 54. The termination of the fire cycle advances the 48 bit shift register pointer bit one position, and the fire cycle can immediately start again. There are 48 fire cycles before all 192 drop ejectors in the array are addressed. At this point the chip is reset via the reset line 52** and the next printing swath begins.

Figure 3:
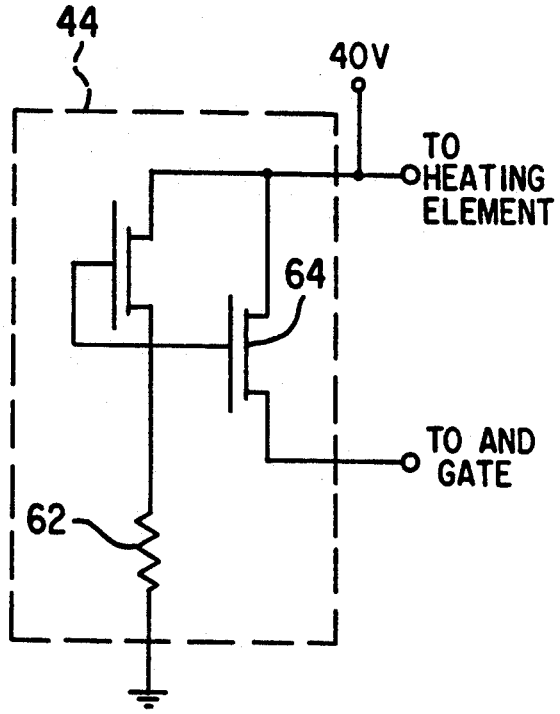
FIG. 3 is a schematic diagram of the power supply circuit of the present invention.

FIG. 3 shows a schematic diagram of power supply 44 and its associated circuitry, which provides for an increased voltage across the heating elements 26 with an increased temperature. A constant voltage of 40 volts is applied to the power supply 44 which uses a voltage divider to control the output. A resistor element 62 is used which has a high, positive temperature coefficient of resistance. The temperature compensating circuit must have a reasonably high temperature coefficient of resistance. In the preferred embodiment either of two materials can be used. The preferred material is a lightly n-doped resistor having a sheet resistance of at least 5 kΩ/□ and a temperature coefficient of resistance of at least 5000 ppm/°C. (0.5%/°C.). The other material, heavily n+doped polysilicon, has a temperature coefficient of resistance of at least 1100 ppm/°C. (0.11%/°C.). In any case, the lower limit on a material's temperature coefficient of resistance is 500 ppm/°C. (0.05%/°C.), but a higher temperature coefficient of resistance is preferred. As temperature increases, the resistor element 62 becomes more resistive and the voltage applied to the gate of power MOSFET 64 increases. The increase in voltage at the gate of power MOSFET 64 is "followed" at the source of power MOSFET 64, so that the voltage to AND gates 42 is increased. When the appropriate signals appear on the latch 60 and 48-bit shift register 48 at the input terminals of AND gates 42, the power supply 44 output voltage is transferred to the gate of power MOSFET driver 40. The conductance of power MOSFET driver 40 increases along with an increase in the voltage applied at the gate of power MOSFET driver 40. As the conductance increases, the voltage across power MOSFET 40 decreases while the voltage across heating element 26 increases.

Figure 4A:
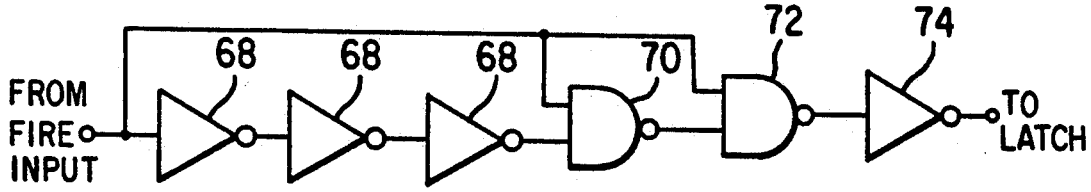
FIG. 4A is a schematic diagram of the delay circuit of the present invention.

FIG. 4A shows the delay circuit 66. FIG. 4C shows the temporal relationship between the input pulse and various outputs. A constant width fire control pulse **58*a* is applied to delay circuit 66. The delay circuit 66 contains temperature sensitive inverters 68 whose transition time increase with temperature. Various amounts of time are subtracted from the width of the fire control pulse 58*a*, depending on the temperature of the temperature sensitive inverters 68. As their temperature goes up, a logic state change presented at the first of the inverters 68 takes longer to propagate through the temperature sensitive inverters. As a result, the output of the first NAND gate 70 is a low-going pulse which stays in the low state longer as temperature increases. This waveform is then input to the second NAND gate 72 to shorten the width of the fire control pulse 58*a* as the temperature increases. A final inverter of the fire control pulse 58*a* as the temperature increases. A final inverter 74 then inverts the signal prior to being applied to latch 60**.

Figure 4B:
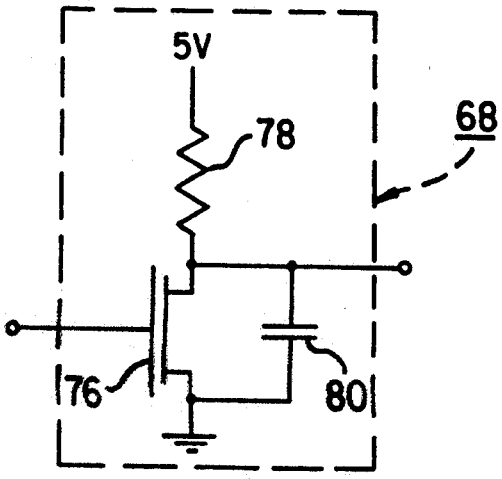
FIG. 4B is a circuit diagram of one of the temperature sensitive inverters of the delay circuit.
Figure 4C:
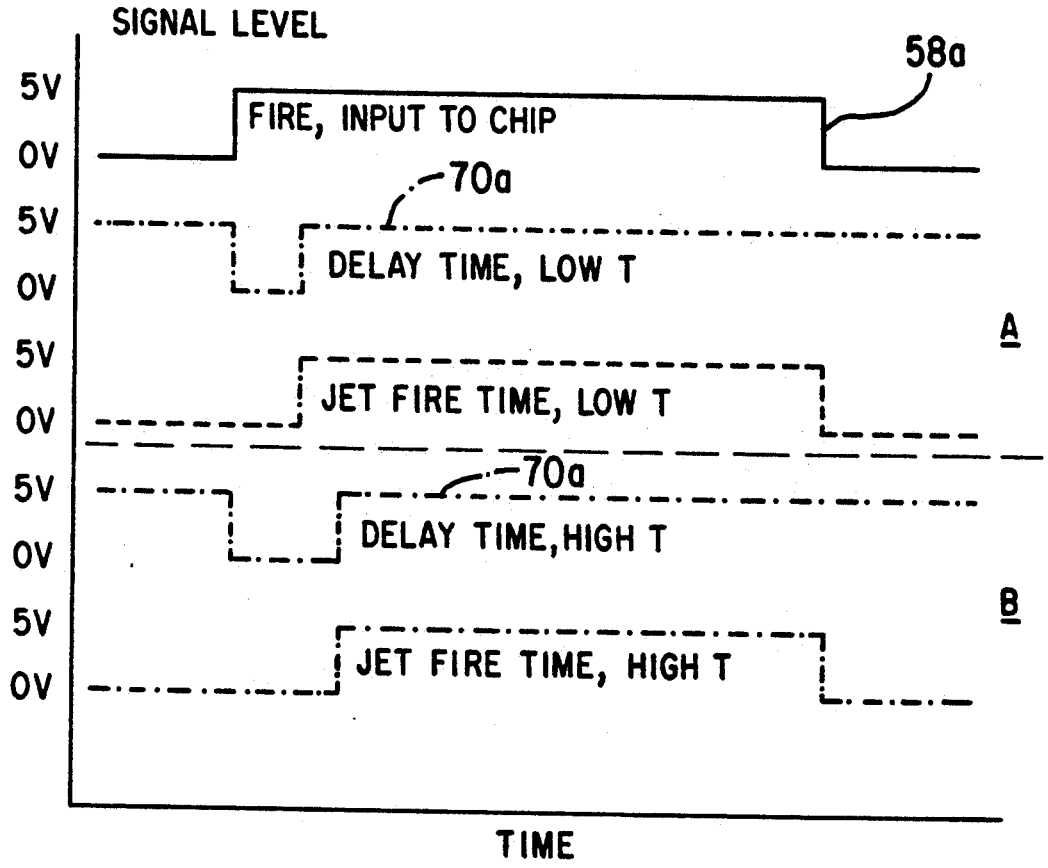
FIG. 4C is a timing diagram showing the delay of the fire pulse.

FIG. 4B is a circuit diagram illustrating one of the temperature sensitive inverters 68 of delay circuit 66. The input to inverter 68 is connected to the gate of logic MOSFET 76, whose drain is connected to temperature sensitive resistor 78, capacitor 80, and the output of inverter 68. Five volts is applied to the temperature sensitive resistor 78. As the temperature increases, the propagation time through the temperature sensitive inverters 68 increases, creating a longer low-going delay pulse **70*a* at the output of the first NAND gate 70**.

FIG. 4C is a timing diagram illustrating the delay of the fire control pulse **58*a*. As temperature increases, the width of the low-going pulse 70*a* at the output of first NAND gate 70 increases, which shortens the width of the fire control pulse 58*a* at the output of delay circuit 66 as the temperature increases. In case A of FIG. 4C, the temperature of the temperature sensitive delay inverters 68** is low, and the width of the low-going pulse 70*a* is narrow. Accordingly, because the NAND gate 72 passes fire control pulse 58*a* only after the pulse 70*a* returns to a high state, the width of fire control pulse 58*a* is effectively shortened by a small amount by the narrow low-going pulse 70*a*. In case B, the temperature of the temperature sensitive delay inverters 68 is high, and low-going pulse 70*a* is wide. Accordingly, the width of the fire control pulse 58*a* output from NAND gate 72 is shortened by a large amount by wide low-going pulse 70*a*. Therefore, the width of fire control pulse 58*a* in case B is shorter than the width of fire control pulse 58*a* in case A, resulting in a shorter duration input signal to the ejectors 10.

Occasionally, certain parts of the printhead will be hotter than other parts during the course of printing a document. For example, in a full page width printhead, the ejectors towards the center of the printhead are likely to be used more heavily than ejectors in positions corresponding to the margins of a document. Due to the increased use, the center portion ejectors will become hotter. With the ink spot size controller 90 of the present invention, numerous delay circuits 66 may be employed (such as, for example, one delay circuit 66 associated with each of the plurality of abutting chips forming a full width printhead) and specific sets of ejectors may be controlled independently from other sets of ejectors, so that certain ejectors 10 will be controlled in accordance with temperature readings from the nearest delay circuit 66. Thus, when a delay circuit 66 in a hot part of a printhead senses a high temperature such as on one chip, that chip may be controlled independently of a chip in a cooler part of the printhead. Therefore, incorporation of this invention into a full width print bar will lead to automatic temperature compensation. Similar results are achieved with 4 separate printheads for color printing.

As is apparent from above, the most important characteristics of the output of the ink spot size controller 90 of the present invention are the amplitude and duration of each fire control pulse 58*a* input to the respective heating elements 26 in each of the nozzles. The amplitude is dependent on the temperature of the power supply 44, while the duration is dependent on the temperature of the delay circuit 66.

One advantage of the preferred embodiment of the present invention is that it may be easily adapted for printheads constructed from assemblies of silicon die modules wherein one portion on the printhead is likely to become hotter than another such portion, as with the full width printhead example described above. With several independent delay circuits located throughout the chip, pulse duration and amplitude may be independently varied to different parts of the chip.

A second advantage of the preferred embodiment of the present invention is color printing with four printheads. It is likely that the temperature of the different color printheads will fluctuate as each is called onto print at different coverages. Incorporation of temperature control into each printhead eliminates color gamut instability.

While this invention has been described in conjunction with the specific apparatus, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A controller for an ink jet printing apparatus having a printhead which includes a plurality of heater elements responsive to electrical input signals to form an ink droplet of substantially constant size, comprising:

power supply means for varying an amplitude of said input signals in relation to a printhead temperature; and delay means for varying a duration of said input signals in relation to the printhead temperature, wherein said power supply means comprises:

a temperature sensitive element having a first end and a second end, the first end of said temperature sensitive element being connected to a ground;

a first transistor configured as a current source, the first transistor having a drain, a source and a gate, the first transistor being connected to the second end of the temperature sensitive element; and a second transistor having a drain, a source and a gate, the drain of said second transistor being connected to the drain of said first transistor, the gate of said second transistor being connected to the source of said first transistor and said source of said second transistor providing an output of said power supply means.

2. The controller of claim 1, wherein said power supply means and said delay means coact to separately vary input signals which are applied to individual heater elements independently of one another.

3. The controller of claim 1, wherein:

separately varied input signals are applied to the heating elements located generally adjacent to said power supply means.

4. The controller of claim 1, wherein the amplitude of said input signals is increased and the duration of said input signals is decreased as the temperature of said printhead increases to maintain a substantially constant ink droplet size invariant of printhead temperature.

5. The controller of claim 1, wherein said power supply means includes a material with a temperature sensitive coefficient of resistance.

6. The controller of claim 5, wherein said power supply means includes a thermistor.

7. The controller of claim 5, wherein said power supply means includes an n-drift layer doping.

8. The controller of claim 5, wherein the temperature sensitive coefficient of resistance of the material is at least 500 ppm/°C.

9. The controller of claim 1, wherein said power supply means and said delay means are monolithically integrated on a printhead chip.

10. The controller of claim 1, wherein said delay means shortens the duration of said input signals as the temperature of said printhead increases.

11. The controller of claim 1, wherein said delay means comprises a temperature dependent delay circuit.

12. The controller of claim 11, wherein said temperature dependent delay circuit, having an input and output, comprises:

a first inverter having an input and an output, said input of said first inverter connected to said input of said delay circuit;

a second inverter having an input and an output, said input of said second inverter being connected to said output of said first inverter;

a third inverter having an input and an output, said input of said third inverter connected to said second inverter;

a first NAND gate having a first input and a second input and an output, said first input of said first NAND gate being connected to said output of said third inverter and said second input of said first NAND gate being connected to said input of said delay circuit; and a second NAND gate having first and second inputs and an output, said first input of said second NAND gate being connected to said output of said first NAND gate, said second input of said second NAND gate being connected to said input of said delay circuit and said output of said second NAND gate being connected to said output of said delay circuit.

13. The controller of claim 12, wherein said first, second and third inverters each have a propagation time that varies with the temperature of said printhead.

14. A thermal ink jet printer, comprising:

a plurality of heater elements for ejecting ink droplets in response to electrical input signals; and an ink spot size controller for generating input signals, wherein the ink spot size controller comprises:

input signals generating means;

power supply means for varying an amplitude of said input signals based on a temperature of the power supply means; and delay means for varying a duration of the input signals based on a temperature of the delay means, wherein said delay means comprises:

a plurality of serially connected temperature sensitive delay elements, a first of the plurality of delay elements connected to the input signals generating means; and a pair of serially connected signal combining elements, a first signal combining element connected to a last of the plurality of delay elements and the input signal generating means, and a second signal combining element connected to the first delay element and the input signal generating means.

15. The thermal ink jet printer of claim 14, wherein, an independent set of the plurality of heater elements is connected to each of the plurality of delay circuits.

16. The thermal ink jet printer of claim 14, where said power supply means comprises a temperature sensitive resistance element.

17. A controller for an ink jet printing apparatus having a printhead which includes a plurality of heater elements responsive to electrical input signals to form an ink droplet of substantially constant size, comprising:

power supply means for varying an amplitude of said input signals in relation to a printhead temperature; and delay means for varying a duration of said input signals in relation to the printhead temperature, wherein said delay means comprises:

a first inverter having an input and an output, said input of said first inverter connected to said input of said delay circuit;

a second inverter having an input and an output, said input of said second inverter being connected to said output of said first inverter;

a third inverter having an input and an output, said input of said third inverter connected to said output of said second inverter;

a first NAND gate having a first input and a second input and an output, said first input of said first NAND gate being connected to said output of said third inverter and said second input of said first NAND gate being connected to said input of said delay circuit; and a second NAND gate having a first input, a second input and an output, said first input of said second NAND gate being connected to said output of said first NAND gate, said second input of said second NAND gate being connected to said input of said delay circuit and said output of said second NAND gate being connected to said output of said delay circuit.

18. The controller of claim 17, wherein said first, second and third inverters each have a propagation time that varies with the temperature of said printhead.

* * * * *